US010260827B2

(12) United States Patent
Mock

(10) Patent No.: US 10,260,827 B2
(45) Date of Patent: Apr. 16, 2019

(54) MAGAZINE CONVERSION SYSTEM AND MAGAZINE JIG

(71) Applicant: Jarret Christian Mock, Fort Myers, FL (US)

(72) Inventor: Jarret Christian Mock, Fort Myers, FL (US)

( * ) Notice: Subject to any disclaimer, the term of this patent is extended or adjusted under 35 U.S.C. 154(b) by 0 days.

(21) Appl. No.: 15/607,517

(22) Filed: May 28, 2017

(65) Prior Publication Data

US 2017/0356709 A1 Dec. 14, 2017

Related U.S. Application Data

(60) Provisional application No. 62/347,133, filed on Jun. 8, 2016.

(51) Int. Cl.

| | |
|---|---|
| ***F41A 3/66*** | (2006.01) |
| ***F41A 11/02*** | (2006.01) |
| ***F41A 15/16*** | (2006.01) |

(52) U.S. Cl.

CPC ..... *F41A 3/66* (2013.01); *F41A 11/02* (2013.01); *F41A 15/16* (2013.01)

(58) Field of Classification Search

CPC ..... F41A 9/25; F41A 9/40; F41A 9/41; F41A 9/63; F41A 9/64; F41A 9/65; F41A 9/71

USPC ..... 42/49.01

See application file for complete search history.

(56) References Cited

U.S. PATENT DOCUMENTS

| | | | | |
|---|---|---|---|---|
| 4,056,038 | A * | 11/1977 | Rath | F41A 5/18 42/16 |
| 4,139,958 | A * | 2/1979 | Foote | F41A 9/71 42/49.02 |
| 5,555,661 | A * | 9/1996 | Yap | F41A 9/71 42/49.02 |
| 6,070,352 | A | 6/2000 | Daigle | |
| 8,898,946 | B1 * | 12/2014 | Johnson | F41A 17/36 42/49.02 |
| 8,966,801 | B1 * | 3/2015 | Bentley | F41A 9/71 42/49.01 |
| 2011/0247483 | A1 * | 10/2011 | Overstreet | F41A 9/70 89/138 |
| 2012/0180360 | A1 * | 7/2012 | Jones | F41A 11/02 42/75.03 |
| 2013/0014418 | A1 * | 1/2013 | Dextraze | F41A 11/02 42/16 |

(Continued)

OTHER PUBLICATIONS

Bartocci, "The Colt 9mm Nato SMG/CARBINE, Small Arms Review," Unknown Date, http://www.smallarmsreview.com/display.article.cfm?idarticles=1326.

(Continued)

*Primary Examiner* — Bret Hayes
(74) *Attorney, Agent, or Firm* — George F. Wallace

(57) ABSTRACT

A magazine conversion system mounts within a magazine well of a lower receiver, and includes a front spacer having a wedge-shaped main body with a lower end, and an upper end having a feed ramp extending upwardly therefrom; and a rear spacer having a wedge-shaped main portion with a lower portion and an upper portion having an ejector element extending upwardly therefrom. With the front and rear spacers positioned within the magazine well, at least a portion of the feed ramp and at least part of the ejector element are positioned above the magazine well.

14 Claims, 3 Drawing Sheets

(56) References Cited

U.S. PATENT DOCUMENTS

| | | | | |
|---|---|---|---|---|
| 2016/0298918 | A1* | 10/2016 | Baker | F41A 9/65 |
| 2017/0138685 | A1 | 5/2017 | Beasley | |
| 2017/0307319 | A1* | 10/2017 | Jarboe | F41A 9/71 |

OTHER PUBLICATIONS

Jew With a Gun, The Hebrew Hammer, "VM HY Tech AR-15 UZI Mag Adapter Review," Feb. 2, 2015, https://hebrewhammerblog.com/2015/02/02/vm-hy-tech-ar-15-uzi-mag-adapter-review/.

Administrator, GunsAmerica News & Reviews, "Colt 901 Modular .308 & .223 Carbine—New Gun Review = LR901-165," Jul. 6, 2012, https://www.gunsamerica.com/blog/colt-901-modular-308-223-carbine-new-gun-review-e901-16s/.

Franky Fun, YouTube, "Olympic Arms AR15 9mm Glock mag adapter part 1," Mar. 22, 2014, https://www.youtube.com/watch?v=WEk8-8nBtxY&feature=youtu.be.

* cited by examiner

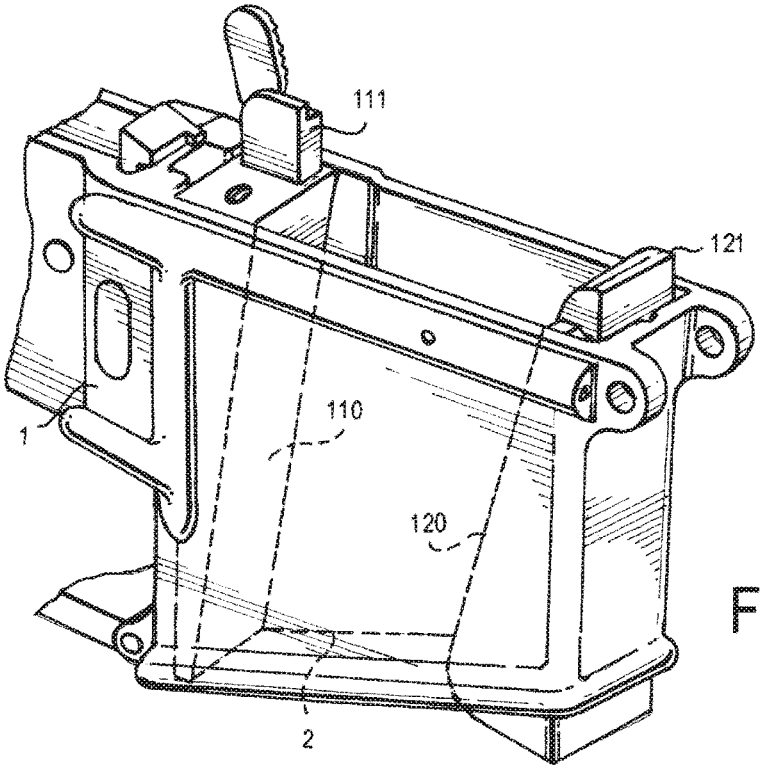
FIG. 3
FIG. 4
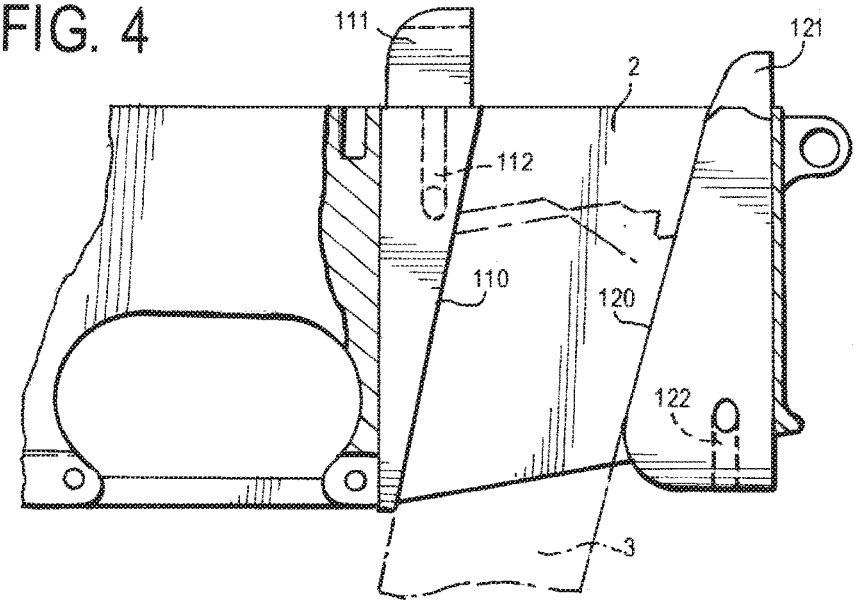

MAGAZINE CONVERSION SYSTEM AND MAGAZINE JIG

RELATED DOCUMENTS

This document is related to, claims the priority benefit of, and incorporates in its entirety, U.S. Provisional Patent Application Ser. No. 62/347,133 entitled "Magazine Conversion System and Magazine Jig" and filed on Jun. 8, 2016 by JARRET CHRISTIAN MOCK.

FIELD OF INVENTION

The present invention relates to firearms and magazines, and more specifically, to magazine conversion systems.

BACKGROUND OF THE INVENTION

A rifle can include an upper and lower receiver, and can be particularly chambered to operate with rounds of a particular caliber. Such a lower receiver can include a magazine well within which an ammunition magazine can snugly engage to maintain the magazine in a static position.

A rifle designed for a particular caliber can be modified to operate with a different caliber. For example, an AR15/M4 rifle, which is typically configured to operate with a 5.56×45 mm or 0.223 Remington round, can be modified to use a 9 mm NATO round by modifying or replacing particular ones of its components, such as for example, its barrel, bolt carrier group, recoil spring, buffer, and hammer. Additionally, conversion blocks, or conversion adapters, have been provided to modify the geometry of the AR15/M4 magazine well, so as to accommodate smaller magazines.

A conversion block is a unitary piece of construction having a rectangular parallelepiped shape with a rectangular parallelepiped cavity passing therethrough. Such a block is positioned within a magazine well to effectively reduce the magazine well size so as to accommodate a smaller magazine for a smaller round size.

SUMMARY OF THE INVENTION

It is an object of the present invention to provide a magazine conversion system and magazine jig.

It is another object of the present invention to provide a magazine conversion system and magazine jig that overcomes at least one deficiency in the prior art.

In an exemplary embodiment of the present invention, a magazine conversion system can be configured to mount within a magazine well of a lower receiver, and can include a front spacer and a rear spacer.

In an exemplary aspect, a front spacer can be provided with a wedge-shaped main body having a lower end and an upper end, and the upper end can include a feed ramp extending upwardly therefrom.

In another exemplary aspect, a rear spacer can be provided with a wedge-shaped main portion having a lower portion and an upper portion, and the upper portion can include an ejector element extending upwardly therefrom.

In yet another exemplary aspect, with the front and rear spacers positioned within a magazine well of a lower receiver, at least a portion of the feed ramp and at least part of the ejector element can be positioned above the magazine well.

In still additional exemplary aspects, optionally, a magazine conversion system can further include at least one of an ammunition magazine having front and rear portions, with the rear portion having a magazine catch notch; and a hollow magazine jig, having a notch guide, and being configured to fit around an ammunition magazine having front and rear portions, such that with the ammunition magazine positioned within the jig, the notch guide exposes an area of the rear portion to be removed to form the magazine catch notch.

A magazine conversion system can optionally include one of more of the following additional exemplary optional aspects: the front spacer can taper from the lower end to the upper end; the rear spacer can taper from the upper portion to the lower portion; at least one of the front spacer and rear spacers can include a respective channel and set screw configured to abut a portion of the magazine well to secure the at least one of said front spacer and said rear spacer within the magazine well.

These and other exemplary aspects and embodiments of the present invention are further described herein.

BRIEF DESCRIPTION OF THE DRAWINGS

FIG. 3 illustrates exemplary front and rear spacers positioned within a magazine well of a rifle lower.

FIG. 4 illustrates exemplary front and rear spacers positioned within a magazine well of a rifle lower and an exemplary ammunition magazine within the magazine well and disposed between the spacers.

DETAILED DESCRIPTION

It is an object of the present invention to provide a magazine conversion system.

It is another object of the present invention to provide a modified magazine.

It should be noted that this disclosure includes a plurality of elements and/or aspects, and such elements and/or aspects need not necessarily be interpreted as being conjunctively required by one or more embodiments of the present invention. Rather, all combinations of the one or more elements and/or aspects can enable a separate embodiment of the present invention, which may be claimed with particularity in one or more future filed Non-Provisional Patent Applications. Moreover, any particular materials, structures, and/or sizes disclosed herein, whether expressly or implicitly, are to be construed strictly as illustrative and enabling, and not necessarily limiting. Therefore, it is expressly set forth that such materials, structures, and/or sizes independently or in any combination of one of more thereof, are merely illustratively representative of one or more embodiments of the present invention and are not to be construed as necessary in a strict sense.

Further, to the extent the same element or aspect is defined differently within this disclosure, whether expressly or implicitly, the broader definition is to take absolute precedence, with the distinctions encompassed by the narrower definition to be strictly construed as optional.

Illustratively, perceived benefits of the present invention can include functional utility, whether expressly or implicitly stated herein, or apparent herefrom. However, it is expressly set forth that these benefits are not intended as exclusive. Therefore, any explicit, implicit, or apparent benefit from the disclosure herein is expressly deemed as applicable to the present invention.

According to one exemplary embodiment, the present invention can include a front spacer and a rear spacer.

According to another exemplary embodiment, the present invention can include a rear spacer, a front spacer, and at least one of an ammunition magazine and a magazine jig.

Figure 1A:
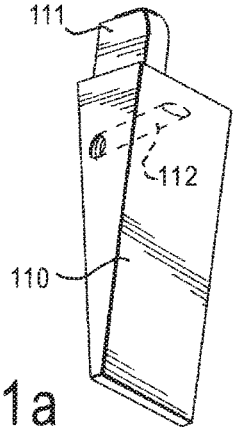
FIG. 1*a* illustrates an exemplary rear spacer having an ejector and a rear channel.
Figure 1B:
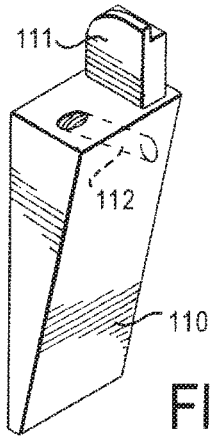
FIG. 1*b* illustrates another perspective of an exemplary rear spacer.
Figure 1C:
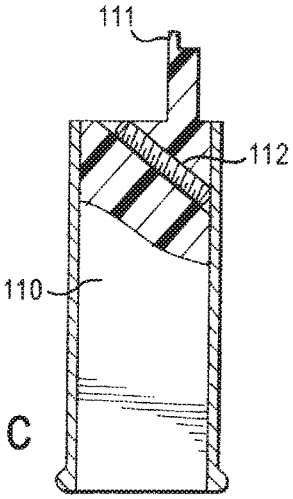
FIG. 1*c* illustrates still another perspective of an exemplary rear spacer.

FIGS. 1*a-c* illustrate different perspectives of an exemplary rear spacer 110 having an ejector 111 and a rear channel 112. When rear spacer 110 is installed (discussed with FIGS. 3 and 4, infra), ejector 111 is positioned to act a fixed abutment that assists in case ejections during rifle operation (not shown). Rear channel 112 is configured to receive a set screw (not shown) so as to statically fix rear spacer 110 via direct or indirect abutment with a magazine well inner portion (infra) to statically fix the rear spacer 110 within a magazine well (infra).

Figure 2A:
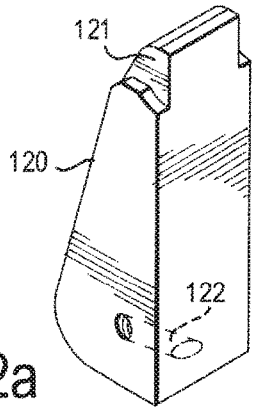
FIG. 2*a* illustrates an exemplary front spacer having a feed ramp and a front channel.
Figure 2B:
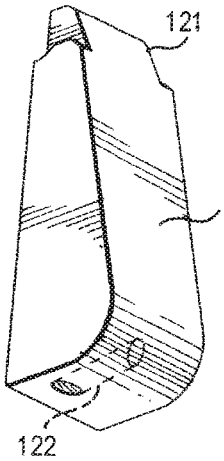
FIG. 2*b* illustrates another perspective of an exemplary front spacer.
Figure 2C:
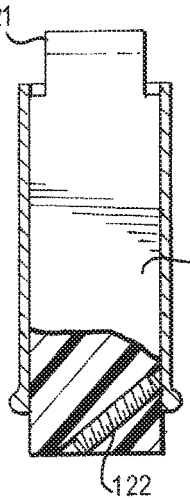
FIG. 2*c* illustrates still another perspective of an exemplary front spacer.

FIGS. 2*a*-2*c* illustrate different perspectives of an exemplary front spacer 120 having an feed ramp 121 and a front channel 122. When front spacer 120 is installed (discussed with FIGS. 3 and 4, infra), feed ramp 121 is positioned to act as a structural guide that facilitates the chambering of rounds during rifle operation (not shown) via its rounded profile. Front channel 122 is configured to receive a set screw (not shown) so as to statically fix front spacer 120 via direct or indirect abutment with a magazine well inner portion to statically fix the front spacer within a magazine well (infra). For example and not in limitation, rear and/or front spacer 110, 120 can be provided with a split configuration (such as a dual piece configuration) such that rotation of a set screw into rear or front channel 112, 122 can force respective spacer portions away from each other whilst within a magwell to fix such a spacer in a static position.

FIG. 3 illustrates exemplary positioning of rear and front spacers 110, 120 within the inside of a magazine well 2 of a lower rifle receiver 1. As illustrated, with front and rear spacers 110, 120 so positioned, set screws (not shown) can be positioned within the rear and front channels 112, 122 and screwed in to abut the inside of magazine well 2 to fix the spacers in position with ejector 111 and feed ramp 121 positioned above the magazine well. As can be seen, when so positioned, rear and front spacers 112, 122 can particularly reduce the available space within a magazine well 2 to accommodate a particularly sized ammunition magazine (infra), which can snugly fit therebetween.

As illustrated in FIG. 4, an ammunition magazine 3, such as a GLOCK™ 9 mm Magazine, for example and not in limitation, can be inserted between rear and front spacers 110, 220. Notably, such an ammunition magazine 3 can include a magazine catch notch 3*a* (see FIG. 6), which can engage with a standard magazine lock (not shown), so as to longitudinally position the magazine to provide rounds at an operational height. For example and not in limitation, a magazine lock can be provided according to the M4 Military Specification, which also serves as the basis for the civilian version AR15 rifle.

Figure 5:
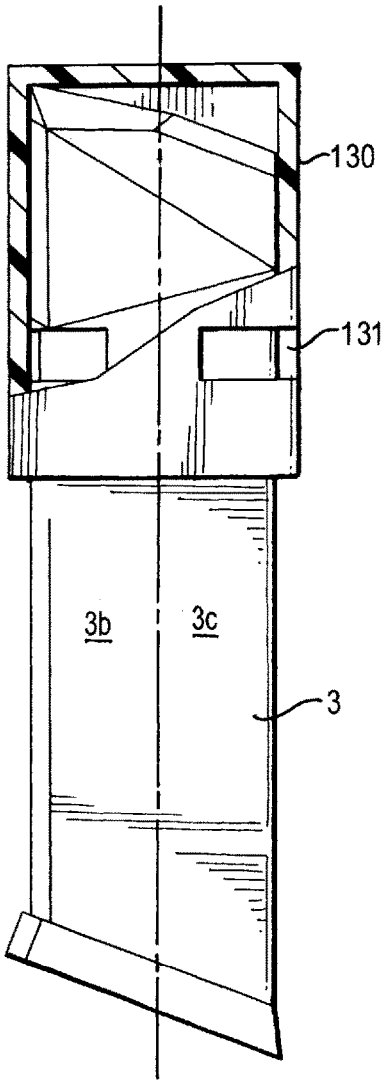
FIG. 5 illustrates an exemplary ammunition magazine having front and rear portions, and an exemplary jig positioned around the ammunition magazine to position a notch guide of the jig over an area of the ammunition magazine where a magazine catch notch can be formed.
Figure 6:
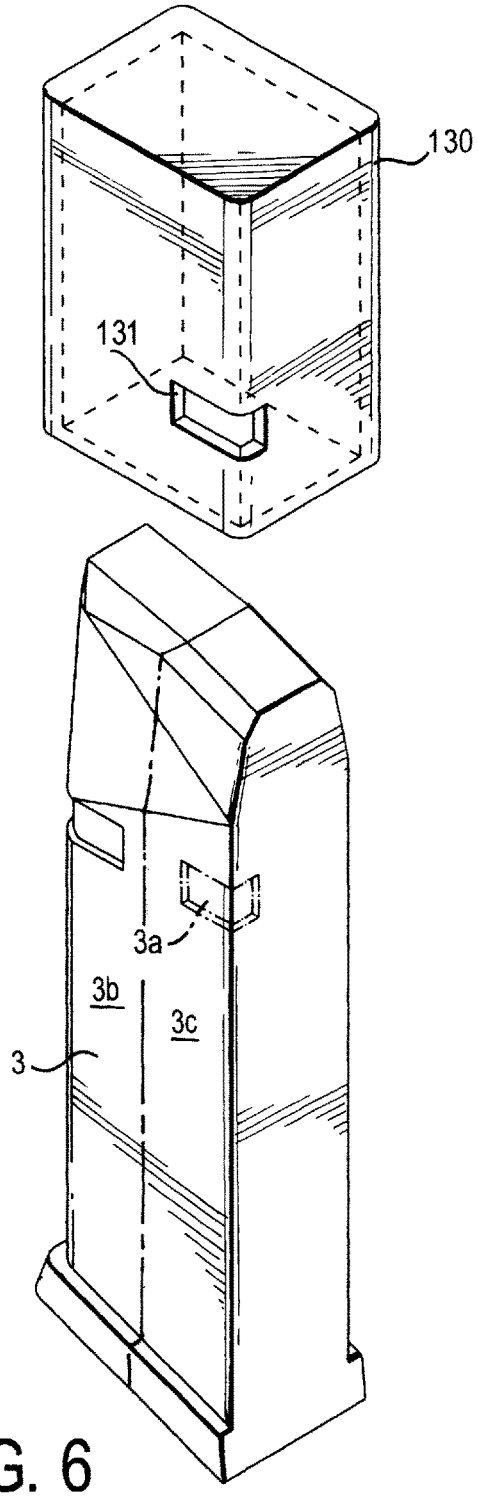
FIG. 6 illustrates an exemplary jig and an exemplary ammunition magazine with a magazine catch notch formed with the jig.

FIG. 5 illustrates an optional magazine jig 130 having a notch guide 131, with the jig positioned over an exemplary ammunition magazine 3 having a front portion 3*b* and a rear portion 3*c*. As further illustrated, notch guide 131 can be positioned over, and to expose, a particular portion of magazine 3 that can be cut out or otherwise removed in a shape consistent with the notch guide. As illustrated in FIG. 6, after such cutting or removing, jig 130 can be removed leaving a magazine catch notch 3*a* particularly positioned on the rear portion 3*c* of ammunition magazine 3.

It will be apparent to one of ordinary skill in the art that the manner of making and using the claimed invention has been adequately disclosed in the above-written and attached description of the exemplary embodiments and aspects of the present invention.

It should be understood, however, that the invention is not necessarily limited to the specific embodiments, aspects, arrangement, steps, and components shown and described above, but may be susceptible to numerous variations within the scope of the invention. For example and not in limitation, each of the various aspects of the present invention can be provided as any one or more desired materials, including but not limited to, plastic, rubber, metal, crystalline, wood, naturally occurring, manmade, etc., insofar as the resulting material or materials are of sufficient rigidity to be functionally compatible with the present invention. Further, while various aspects of the present invention have been illustrated as having particular shapes, they may be provided in any one or more desired shapes, including any geometric, symmetric, asymmetric, and/or irregular shape to the extent the resulting aspect is functionally compatible with the present invention.

Therefore, the specification and drawings are to be regarded in an illustrative and enabling, rather than a restrictive, sense.

Accordingly, it will be understood that the above description of the embodiments of the present invention are susceptible to various modifications, changes, and adaptations, and the same are intended to be comprehended within the meaning and range of equivalents apparent to one of ordinary skill in the art.

Therefore, I claim:

1. A magazine conversion system configured to mount within a magazine well of a lower receiver, comprising:

a front spacer having a wedge-shaped main body with a lower end and an upper end, the upper end having a rounded and upwardly facing feed ramp portion extending upwardly therefrom; and a rear spacer having a wedge-shaped main portion with a lower portion and an upper portion, the upper portion having an ejector element extending upwardly therefrom;

wherein with said front and rear spacers positioned within the magazine well, at least a portion of the feed ramp portion and at least part of the ejector element are positioned above the magazine well and the feed ramp portion is immovable relative to said front spacer.

2. The magazine conversion system of claim 1, further comprising:

an ammunition magazine having a front portion and a rear portion, the rear portion having a magazine catch notch.

3. The magazine conversion system of claim 1, wherein said front spacer tapers from the lower end to the upper end.

4. The magazine conversion system of claim 3, further comprising:

an ammunition magazine having a front portion and a rear portion, the rear portion having a magazine catch notch.

5. The magazine conversion system of claim 1, wherein said rear spacer tapers from the upper portion to the lower portion.

6. The magazine conversion system of claim 5, further comprising:

an ammunition magazine having a front portion and a rear portion, the rear portion having a magazine catch notch.

7. The magazine conversion system of claim 5, wherein said front spacer tapers from the lower end to the upper end.

8. The magazine conversion system of claim 7, further comprising:

an ammunition magazine having a front portion and a rear portion, the rear portion having a magazine catch notch.

9. The magazine conversion system of claim 1, wherein at least one of said front spacer and said rear spacer includes a channel and a set screw configured to abut a portion of the magazine well to secure the at least one of said front spacer and said rear spacer within the magazine well.

10. The magazine conversion system of claim 9, further comprising:

an ammunition magazine having a front portion and a rear portion, the rear portion having a magazine catch notch.

11. The magazine conversion system of claim 1, wherein said front and rear spacers are configured to be spaced apart within the magazine well to accommodate an ammunition magazine to be positioned therebetween.

12. The magazine conversion system of claim 11, further comprising:

an ammunition magazine having a front portion and a rear portion, the rear portion having a magazine catch notch.

13. The magazine conversion system of claim 1, further comprising:

a hollow magazine jig, having a notch guide, and being configured to fit around an ammunition magazine having front and rear portions;

wherein with the ammunition magazine positioned within said jig, the notch guide exposes an area of the rear portion to be removed to form a magazine catch notch.

14. The magazine conversion system of claim 13, further comprising:

an ammunition magazine having a front portion and a rear portion, the rear portion having a magazine catch notch.

* * * * *